US006198492B1

(12) United States Patent
Wakahara et al.

(10) Patent No.: US 6,198,492 B1
(45) Date of Patent: Mar. 6, 2001

(54) CONTROL ELECTRODE CLEANING DEVICE

(75) Inventors: Shirou Wakahara, Osaka; Yoshitaka Matsumoto, Shijonawate, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 08/904,281

(22) Filed: Jul. 31, 1997

(30) Foreign Application Priority Data

Sep. 3, 1996 (JP) ..... 8-232883

(51) Int. Cl.[7] ..... B41J 2/39
(52) U.S. Cl. ..... 347/141
(58) Field of Search ..... 347/55, 123, 124, 347/141, 125, 128; 399/66, 100, 171

(56) References Cited

U.S. PATENT DOCUMENTS

| | | | | |
|---|---|---|---|---|
| 4,903,050 | | 2/1990 | Schmidlin | 347/55 |
| 5,233,392 | * | 8/1993 | Kitamura | 347/123 |
| 5,523,777 | | 6/1996 | Kitamura | 347/55 |

FOREIGN PATENT DOCUMENTS

| | | |
|---|---|---|
| 0 709 748 | 5/1996 | (EP) . |
| 6-155 798 | 6/1994 | (JP) . |
| 6-218 981 | 8/1994 | (JP) . |
| WO 90/14959 | 12/1990 | (WO) . |

OTHER PUBLICATIONS

Patent Abstracts of Japan, Publication No.: 4 269 563, Publication date: Sep. 25, 1992 Title: Direct Electrostatic Recorder.

Patent Abstracts of Japan, Publication No. 6 135 049, Publication date May 17, 1994 Title: Image Recorder.

Xerox Disclosure Journal, vol. 21, No. 5, Sep. 1996, p. 301/302 Schmidlin F W et al. "Improved Direct Electrostatic Printing Printhead Cleaning Cycle" XP 000 687 136.

* cited by examiner

*Primary Examiner*—N. Le
*Assistant Examiner*—Judy Nguyen
(74) *Attorney, Agent, or Firm*—Dike, Bronstein, Roberts & Cushman, LLP; David G. Conlin; William J. Daley, Jr.

(57) ABSTRACT

The opposing electrode has an opposing portion facing the peripheral surface of the toner support and a brush portion formed of a partial circumferential surface continuous to both ends of the opposing portion. The opposing electrode is rotated about a rotary axis disposed at the center of the partial circumference forming the brush portion. When the opposing electrode rotates, the brush portion comes into contact with the undersurface of the control electrode. The opposing electrode is applied with a high voltage, e.g. 2 kV from a high-voltage power source so that the brush portion can remove the toner adhering to the control electrode.

5 Claims, 14 Drawing Sheets

CONTROL ELECTRODE CLEANING DEVICE

BACKGROUND OF THE INVENTION (1) Field of the Invention

The present invention relates to an image forming apparatus such as a digital copier, facsimile machine, page printer and the like, in particular relating to an image forming apparatus which forms images by causing developer particles to jump to the recording medium.

(2) Description of the Prior Art

Among image forming apparatuses for outputting image data as a visual image on recording medium such as recording paper etc., one type is known which directly forms a toner image on the recording medium by making toner, the developer, jump onto the recording medium, as has been disclosed in Japanese Patent Application Laid-Open Hei 6 No. 155,798. As shown in FIG. 1, the image forming apparatus includes an image forming unit 151 having a toner supplying section 152 and a printing section 153. In this apparatus, toner 171 is made to jump from toner supplying section 152 and adhere to a sheet of paper 155, the recording medium. During this, the jumping of toner 171 is controlled in accordance with the image data.

Toner supplying section 152 is composed of a toner reservoir 170 for holding toner 171 as negatively charged developer particles, and a toner support 172 which supports toner 171 on its peripheral surface by magnetic force whilst rotating in the direction of arrow E. Printing section 153 is composed of an opposing electrode 175 of a cylindrical shape and a control electrode 176 which is provided between opposing electrode 175 and toner support 172. Opposing electrode 175 rotates in the direction of arrow F so that paper 155 is conveyed between opposing electrode 175 and control electrode 176 in the direction of arrow G.

As shown in FIG. 2, control electrode 176 has a plurality of gates 179 formed therein, each gate 179 having an annular electrode 177 formed around the edge thereof. As a voltage from a control power source 181 shown in FIG. 1 is selectively applied to these annular electrodes 177 in accordance with the image data, toner 171 supported on the peripheral surface of toner support 172 is made to jump toward opposing electrode 175 and pass through selective gates 179 hence being made to adhere to paper 155 which is placed between opposing electrode 175 and control electrode 176.

The image forming apparatus configured as above is one which directly forms the image on the surface of recording medium such as paper etc. Therefore, it is no longer necessary to use a developer medium such as a photoreceptor etc., which was used in conventional image forming apparatuses. Further, the step for transferring the image from the developer medium to the paper can be omitted, thus making it possible to eliminate degradation of the image due to this operation. Moreover, the structure of the apparatus can be simplified needing fewer parts, thus making it possible to reduce the apparatus in size and cost.

Since, in the image forming apparatus directly forming the image by making the toner jump as described above, the toner is selectively made to jump to form an image by controlling the voltage of the control electrode, the controllability of the voltage in the control electrode has a critical influence on the state of the image to be formed. The adherence of the toner bearing static charge is one of the typical causes that degrade the controllability of the voltage in the control electrode. More specifically, the potential of the control electrode on the basis of the toner supported on the toner support varies to a potential different from that applied to the control electrode for image forming, due to the potential which is derived from the static charge on the toner adhering to the control electrode, with respect to the control electrode. For example, if a voltage that allows the passage of toner is applied to the control electrode, the actual voltage may vary or be close to a potential that prohibits the passage of toner, due to the static charge on the toner adhering to the control electrode, and hence no or only an insufficient amount of toner will transfer from the toner support to the paper. Resultantly, the condition of the image formed will be badly deteriorated with image defects, print failure, low contrast and reproduction failure of halftone images.

Adherence of the toner to the control electrode occurs on the surface thereof and the interior of the gates, due to electrically attractive force, typified by 'image force', as well as because the friction between the toner surface and the control electrode surface exceeds the electric force exerting on toner particles from the electric fields formed between the control electrode and the opposing electrode or formed between the control electrodes and the toner support. As a result, in order to remove the toner adhering on the control electrode, it is necessary to create a stronger electric field or urging force by a physical method.

In order to create a stronger electric field than that formed between the control electrode and the opposing electrode, it is necessary to apply a greater voltage to the opposing electrode or place the opposing electrode closer to the control electrode. However, creation of a stronger electric field between the control electrode and the opposing electrode requires additional components such as a high-voltage power source and its control circuits. On the other hand, an arrangement of placing the opposing electrode closer to the control electrode requires a device for shifting the opposing electrode toward the control electrode. In either case, it is impossible to avoid sharp increase in the size and cost of the apparatus due to an increased number of parts.

Because of the above reasons, Japanese Patent Application Laid-Open Hei 6 No. 218,981 discloses a configuration in which a bar having an opposing electrode at one end thereof is provided rotatably at the middle part thereof and the other end has a brush roller or scraper to be abutted against the surface of the control electrode. Other configurations than this, are also disclosed such as that having an adhesive tape selectively contacting the surface of the control electrode, that having an air stream generating means for blowing an air stream onto the surface of the control electrode, and that having a vibrating means for vibrating the control electrode.

However, any of the configurations disclosed in Japanese Patent Application Laid-Open Hei 6 No. 218,981 cannot avoid the problem of increase in the size and cost of the apparatus due to an increased number of parts. Further, when adhering toner is removed from the control electrode by blowing an air stream over the surface of the control electrode or vibrating the control electrode, an extensive area other than the control electrode inside the apparatus will be stained with toner.

SUMMARY OF THE INVENTION

It is therefore an object of the present invention to provide an image forming apparatus which can reliably avoid deterioration of the condition of formed images, by definitely removing toner adhering to the control electrode by a simple configuration without sharp increase in the size and cost of the apparatus.

The present invention has been devised to attain the above object and is configured as follows:

In accordance with the first aspect of the invention, an image forming apparatus includes:

a supporting medium for supporting the electrified developer;

an opposing electrode spaced a predetermined distance apart from the supporting medium and disposed facing the supporting medium; and a control electrode disposed between the supporting medium and the opposing electrode and having a plurality of gates which form passage for the developer particles, wherein the image forming apparatus forms a visual image on a recording medium conveyed between the opposing electrode and the control electrode whilst varying the potential applied to the control electrode so as to selectively control transfer of the developer particles through the gates, and is characterized in that the opposing electrode is made up of a rotary body having a rotational axis orthogonal to the conveying direction of the recording medium so as to rotate during the non-image forming mode, and the circumferential surface of the opposing electrode is formed with an opposing portion which faces the control electrode during the non-rotating mode and a cleaning portion which comes closer to the control electrode during rotation.

In accordance with the second aspect of the invention, an image forming apparatus having the first feature is constructed so that the direction or the strength of the electric field generated between the opposing electrode and the control electrode is varied during the non-image forming mode.

In accordance with the third aspect of the invention, an image forming apparatus having the first feature is constructed so that the opposing electrode has a plurality of opposing portions and cleaning portions alternatively arranged on the peripheral surface of the rotary body along the circumferential direction.

In accordance with the fourth aspect of the invention, an image forming apparatus having the second feature is constructed so that the opposing electrode has a plurality of opposing portions and cleaning portions alternatively arranged on the peripheral surface of the rotary body along the circumferential direction.

In accordance with the invention of the above first feature, the opposing electrode as a rotary body rotates during the non-image forming mode so that the cleaning portion formed on the peripheral surface of the rotary body can come closer to control electrode. The toner adhering to the control electrode transfers to the cleaning portion located in proximity thus being removed from the control electrode.

In accordance with the invention of the above second feature, even when toner having static charge of an opposite polarity to the predetermined polarity is adhering to the control electrode, it is possible to definitely remove the toner adhering to the control electrode.

In accordance with the invention of the above third and fourth features of the invention, the rotational angle of the rotary body during the non-image forming mode can be reduced so as to shorten the interval between recording media.

DESCRIPTION OF THE PREFERRED EMBODIMENTS

Figure 1:
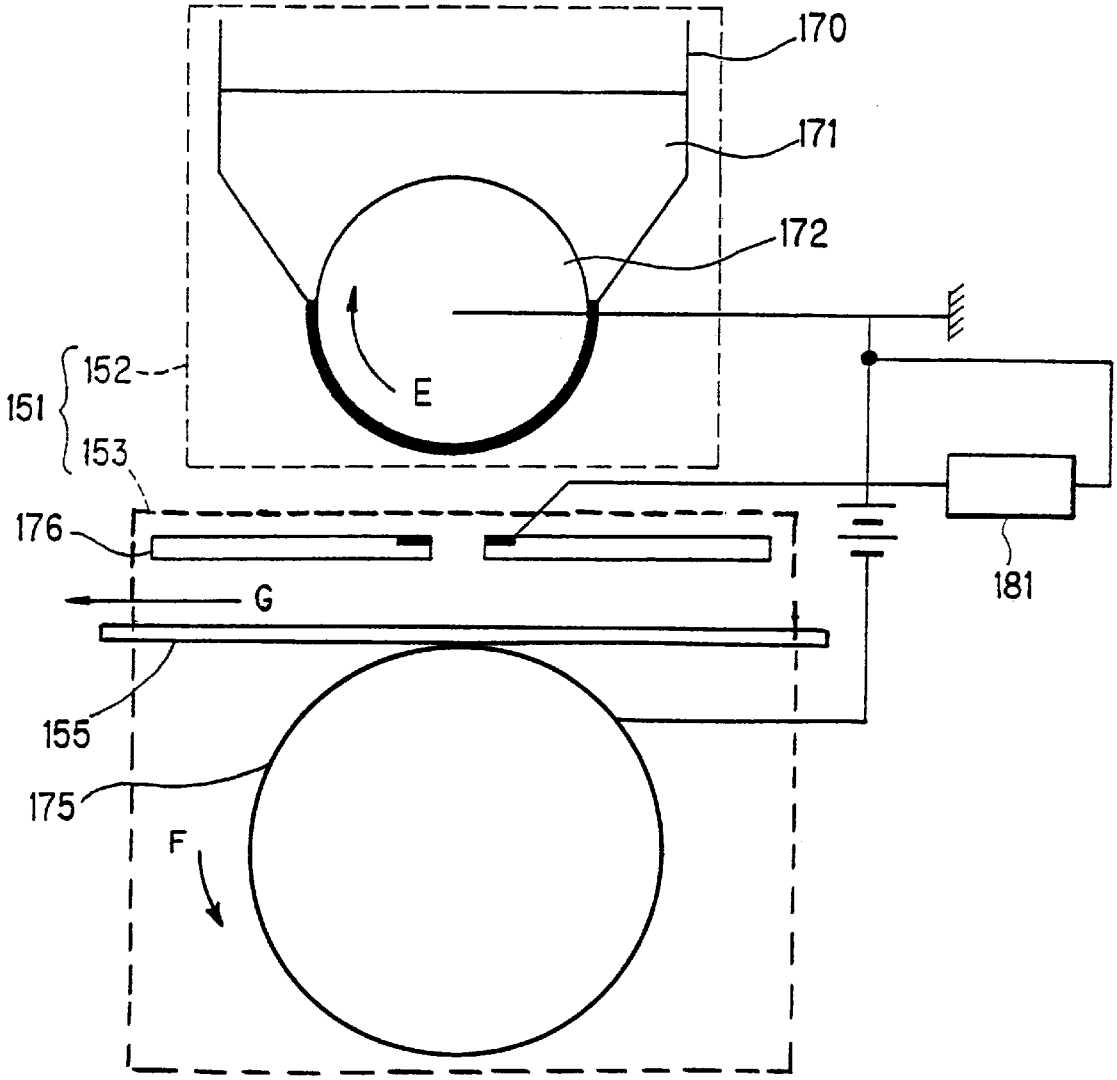
FIG. 1 PRIOR ART
FIG. 1 is a schematic view showing the configuration of essential components of a conventional image forming apparatus.
Figure 2:
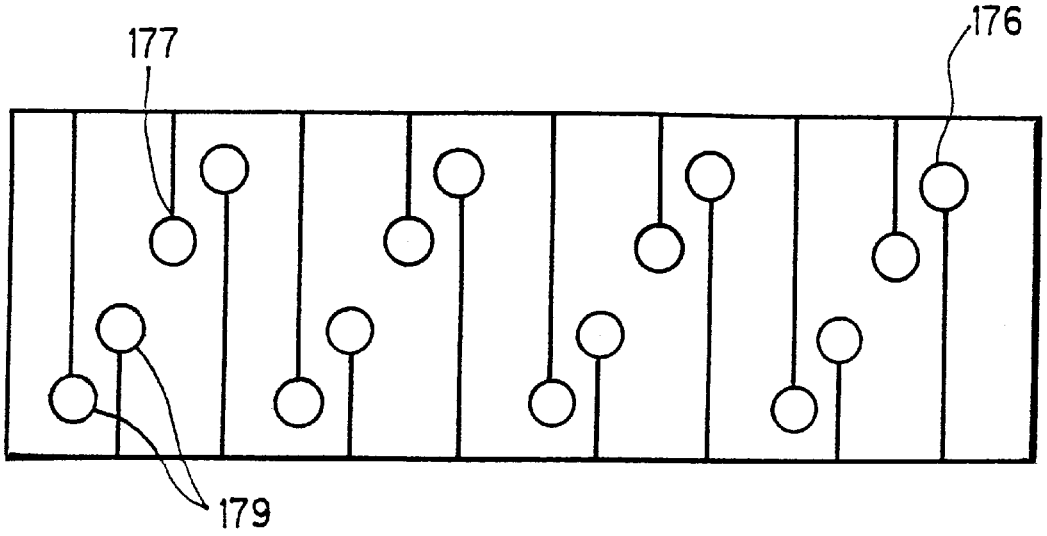
FIG. 2 PRIOR ART
FIG. 2 is a view showing a forming state of the toner-free area on the toner support in the conventional image forming apparatus.
Figure 3:
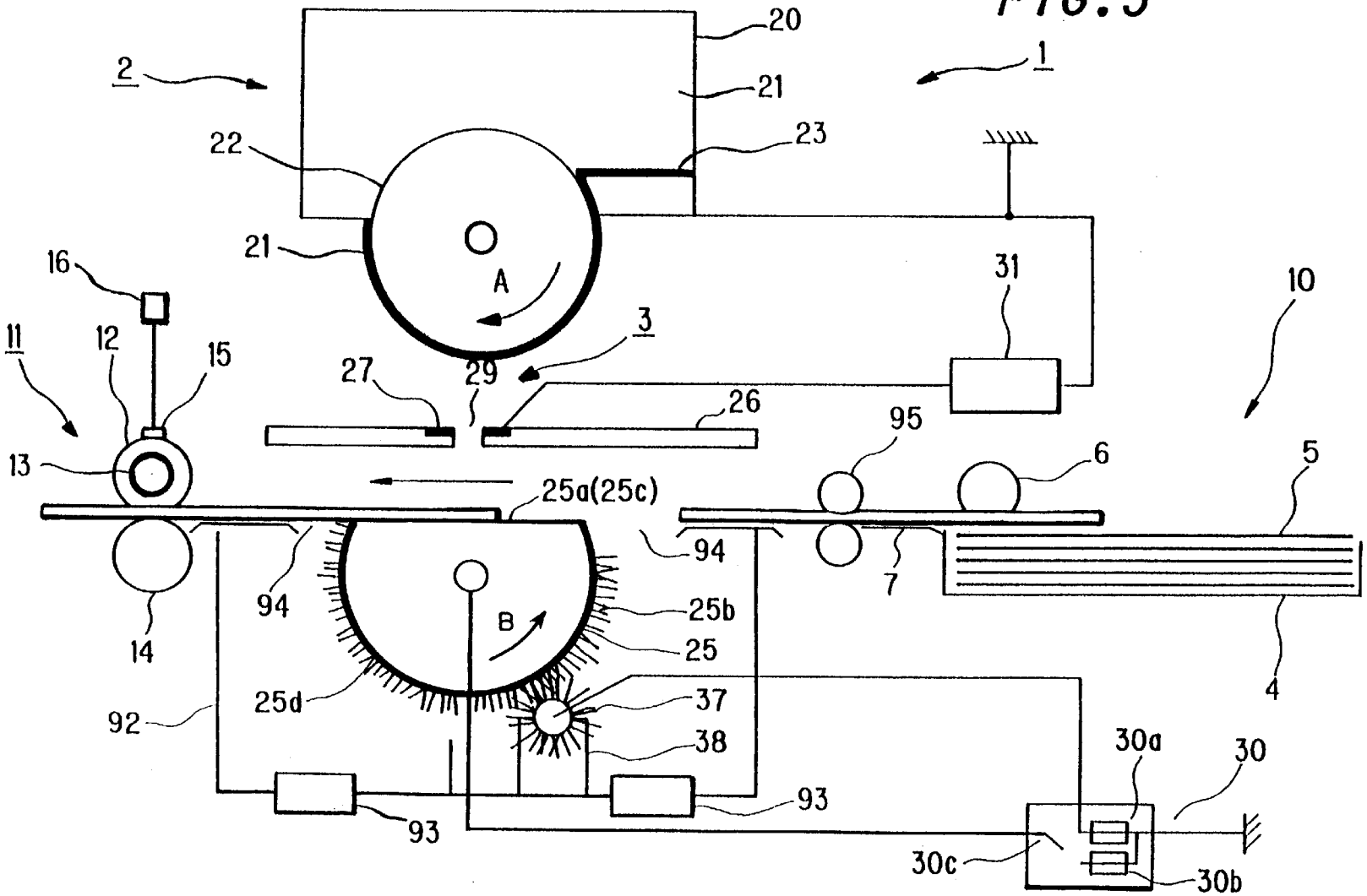
FIG. 3 is a schematic view showing the configuration of essential components of an image forming apparatus to which the present invention is applied.

FIG. 3 is a view showing the configuration of an image forming apparatus of a typical embodiment of the invention. This image forming apparatus has an image forming unit 1 which is composed of a toner supplying section 2 and a printing section 3. Image forming unit 1 creates a visual image in accordance with an image signal, onto a sheet of paper as recording medium with toner as the developer. In this image forming apparatus, the toner is made to jump and adhere onto the paper whilst the jumping of the toner is controlled based on the image forming signal, so as to directly form the image on the paper. Provided on the paper input side of image forming apparatus 1 is a paper feeder 10, which is composed of a paper cassette 4 for storing sheets of paper 5 as recording medium, a pickup roller 6 for delivering paper 5 supplied from paper cassette 4, and a paper guide 7 for guiding paper 5 sent out. Pickup roller 6 receives rotational force from an unillustrated driver.

Provided on the output side of image forming apparatus 1 is a fixing unit 11 for heating and pressing the toner image which was formed on paper 5 at the image forming unit 1, to fix it onto paper 5. Fixing unit 11 is composed of a heat roller 12, a heater 13, a pressing roller 14, a temperature sensor 15, and a temperature controller circuit 16. Heat roller 12 is made up of, for example, an aluminum pipe of about 2 mm thick. Heater 13 is a halogen lamp, for example, which is incorporated in heat roller 12. Pressing roller 14 is made up of silicone resin, for example. Heat roller 12 and pressing roller 14 are pressed against one another under a constant pressure by means of an unillustrated elastic body. Temperature sensor 15 measures the surface temperature of heat roller 12. Temperature controlling circuit 16 which is centrally controlled by an unillustrated main controller, controls the operation of heater 13 based on the measurements from temperature sensor 15 so that the surface temperature of heat roller 12 is maintained at 150° C., for example, which allows for the melting of the toner. Fixing unit 11 has an unillustrated paper discharge sensor for detecting the discharge of paper 5. Here, fixing unit 11 may be constructed so that the toner image is fixed to paper 5 by either heating or pressing alone.

Toner supplying section 2 in image forming apparatus 1 is composed of a toner reservoir 20 for storing toner 21 as the developer, a cylindrical support 22 for magnetically supporting toner 21, a doctor blade 23 which imparts charge to toner 21 and regulates the thickness of the toner layer carried on the peripheral surface of toner support 22. Doctor blade 23 is arranged on the upstream side of toner support 22 with respect to the rotational direction of the peripheral surface of toner support 22, spaced with a distance of about 60 μm, for example, from the peripheral surface of toner support 22. Toner 21 is of a magnetic type having a mean particle diameter of, for example, 6 μm, and is electrified with static charge of −4 μC/g to −5 μC/g by doctor blade 23. Toner support 22 is, in general, so arranged that rotational force is provided from a drive controller which controls a motor in a constant rotational speed, by such means as a gear connected to a motor, which is further connected to a rotational shaft of the toner support 22 so that it rotates at a constant peripheral speed, e.g. 120 mm/sec in the direction indicated by arrow A. Toner support 22 is grounded and has unillustrated fixed magnets therein, at the position opposite doctor blade 23 and at the position opposite a control electrode 26 (which will be described later). This arrangement permits toner support 22 to magnetically carry toner 21 on its peripheral surface, and toner 21 supported on the peripheral surface of toner support 22 is made to stand up in 'spikes' at the areas corresponding to the positions of the magnets. Toner support 22 can be configured so as to support toner 21 by electric force or combination of electric and magnetic forces.

Printing section 3 includes: an opposing electrode 25 which faces the peripheral surface of toner support 22; a high-voltage power source 30 for applying a high voltage to opposing electrode 25; a control electrode 26 provided between toner support 22 and opposing electrode 25; a second cleaning means 37 disposed in proximity to opposing electrode 25 and supported by a supporting portion 38; and a suction device 92.

Opposing electrode 25 has a flat portion 25*a* as an opposing portion facing the peripheral surface of toner support 22 and a brush portion 25*b* formed of a partial circumferential surface continuous to both ends of flat portion 25*b*. This brush portion 25*b* is the cleaning portion of this invention. Flat portion 25*a* as an opposing portion of opposing electrode 25 is positioned 1.1 mm, for example, apart from the peripheral surface of toner support 22. The surface of flat portion 25*a* is made up of PVDF as a substrate with a dielectric layer 25*c* having a volume resistivity of $10^{10}\Omega\cdot$cm and a thickness of 75 μm, coated thereon.

Opposing electrode 25 is axially supported by a rotary axis 25*d* disposed at the center of the partial circumference forming brush portion 25*b*, and is rotated in the direction of arrow B in the figure by rotational force imparted from an unillustrated driver. When opposing electrode 25 rotates, brush portion 25*b* of the opposing electrode comes in contact with the undersurface of control electrode 26. Opposing electrode 25 is applied with a high voltage, e.g. 2 kV from high-voltage power source 30. In this geometry, an electrical field necessary for causing toner 21 carried on the peripheral surface of toner support 22 to jump toward opposing electrode 25 is created between opposing electrode 25 and toner support 22.

In place of brush portion 25*b*, a blade which will abut the undersurface of control electrode 26 as opposing electrode 25 rotates, can be attached to opposing electrode 25.

Second cleaning means 37 is made up of a cylindrical brush, for example, and is rotatably supported by supporting portion 38. This second cleaning means 37 comes in contact with flat portion 25*a* of opposing electrode and brush portion 25*b*. The same voltage as applied to opposing electrode 25 from high-voltage power source 30 during the image forming operation is applied also to this second cleaning means 37. Second cleaning means 37 can be made up of a blade which abuts both flat portion 25*a* of opposing electrode 25 and brush portion 25*b*.

Suction device 92 includes a container 93*a* for accommodating opposing electrode 25 and a fan 93 and sucks, by its rotation, the air over the opposing electrode 25 through a plurality of suction holes 94 provided around opposing electrode 25, so that paper 5 fed from paper feeder 10 will be pulled toward the opposing electrode 25 side so as not to touch control electrode 26.

It should be noted that this image forming apparatus includes: a main controller as a control circuit for controlling the whole image forming apparatus; an image processor for converting the image data which was obtained from image pickup device into an image data format by which the image can be printed; an image memory for storing the converted image data; and an image forming control unit for converting the image data obtained from the image processor into the image data to be given to control electrode 26.

Figure 4:
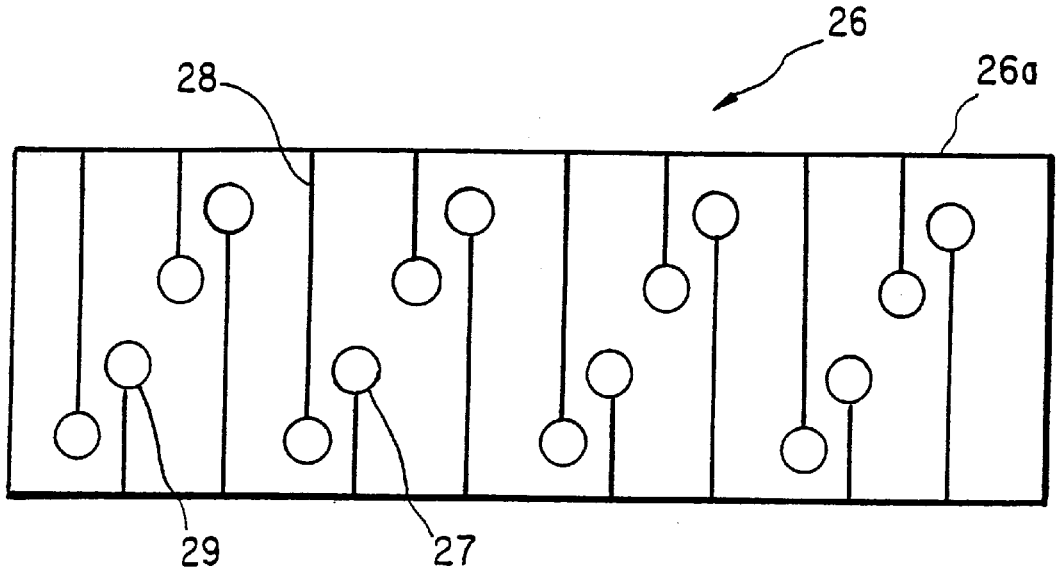
FIG. 4 is a plan view showing essential components of a control electrode provided in the image forming apparatus.

FIG. 4 is a plan view showing the control electrode provided in the above image forming apparatus. Control electrode 26 is supported parallel to flat portion 25*a* of opposing electrode 25 by means of an unillustrated supporter member so that its distance from the peripheral surface of toner support 22 is set at, for example, 100 μm. Control electrode 26 is composed of an insulative board 26*a* made of a polyimide resin or the like of about 25 μm thick with a plurality of annular electrodes 27 formed independently of each other. Annular electrodes 27 are formed of copper foil, for example, of 30 μm thick, and have an outside diameter of 220 μm and inside diameter of 200 μm. The bore of each annular electrode 27 forms a gate 29 allowing passage for toner 21 to jump from the peripheral surface of toner support 22 toward opposing electrode 25. Each annular electrode 27 is connected to a control power source 31 via a feeder line 28 and an unillustrated high voltage driver. In control electrode 26, gates 29 as well as annular electrodes 27 are formed at 2,560 sites, for instance. This number corresponds to a resolution of 300 DPI across the width of A4 sized paper, or in the direction perpendicular to the conveyance direction of the paper. The surface of annular electrodes 27 as well as the surface of feeder lines 28 is coated with an insulative layer of 30 μm thick, thus ensuring insulation between annular electrodes 27, insulation between feeder lines 28, and insulation between annular electrodes 27 and feeder lines 28, not related to each other.

Each annular electrode 27 of control electrode 26 is applied with a voltage from control power source 31 in accordance with the image signal. Actually, when the voltage to be applied to annular electrodes 27 is controlled by control power source 31, the intensity of the electric field between toner support 22 and opposing electrode 25 varies so that the jumping of toner 21 from toner support 22 to opposing electrode 25 is controlled. Specifically, a voltage is selectively applied to annular electrode 27 from control power source 31 in accordance with the image data. When toner 21 supported on toner support 22 needs to be transferred toward opposing electrode 25, control power source 31 applies a voltage, e.g. 150 V to annular electrodes 27, whereas it applies another voltage, e.g. −200 V when the toner is not to be transferred. In this way, whilst the potential to be imparted to control electrode 26 is controlled in accordance with the image data, paper 5 is fed along opposing electrode 25 on the side thereof facing toner support 22. As a result, the toner image is formed on the surface of paper 5 in accordance with the image data. Here, control power source 31 is controlled by a control-electrode controlling signal transmitted from an unillustrated image forming control unit.

Figure 5:
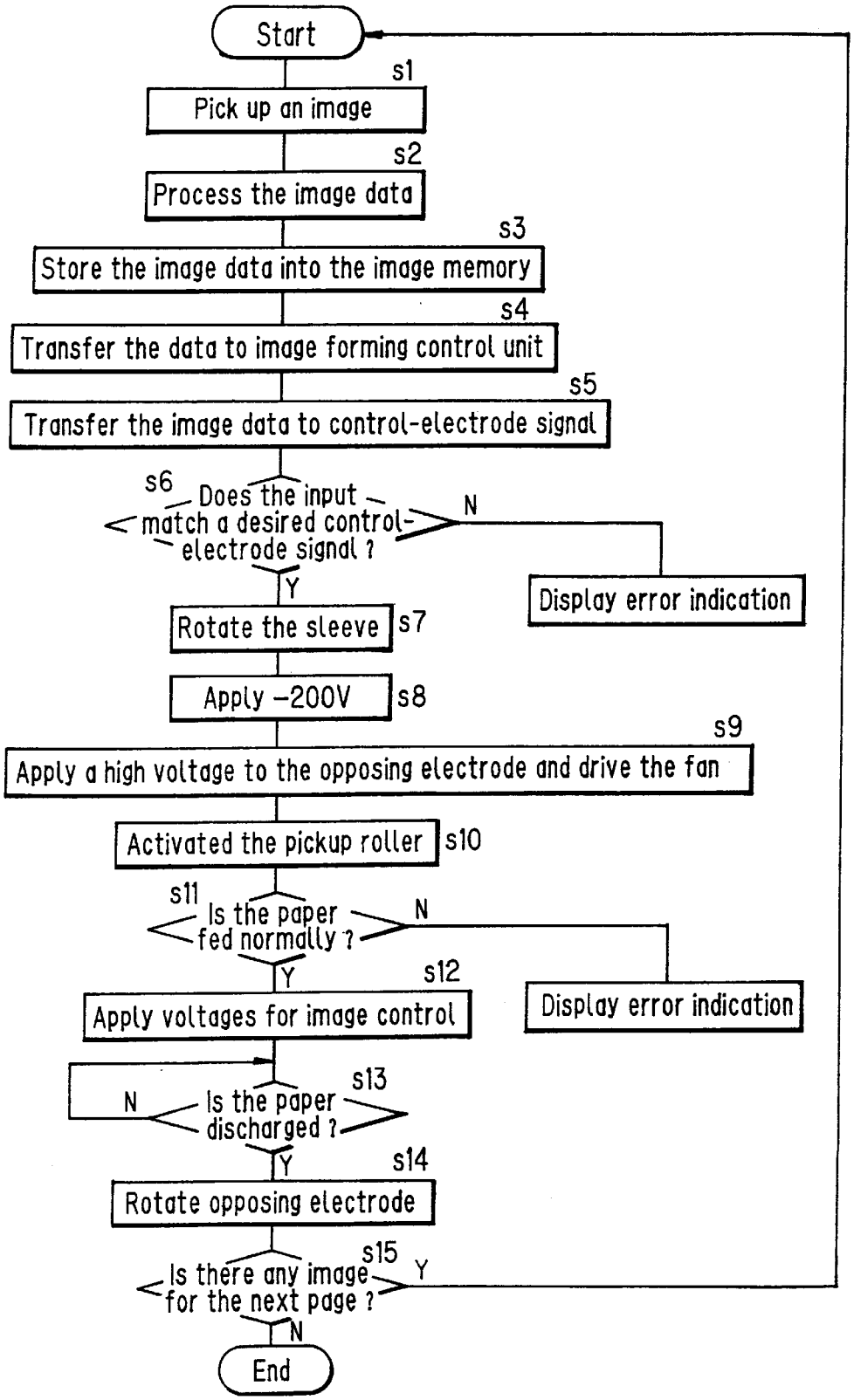
FIG. 5 is a flowchart showing the procedural flow of an image forming operation in the image forming apparatus.

FIG. 5 is a flowchart showing the procedural flow of the image forming operation of the image forming apparatus. When the copy start key is operated with an original set on the image pickup section, the image reading operation is effected. Illustratively, the image pickup section reads the image of the original, and the image data thus picked up is image processed in the image processing section to be stored into the image memory (s1–s3). This image data is transferred to the image forming control unit at a predetermined timing (s4) so that the image forming control unit transforms the input image data into a control-electrode controlling signal to be imparted to control electrode 26 (s5). When the image forming control unit has created a predetermined amount of the control-electrode controlling signal, it causes toner support 22 to rotate (s6, s7) while a voltage of −200 V is applied to control electrode 26 (s8). At the same time, a high-voltage is applied to opposing electrode 25 and a fan 93 of suction device 92 is activated (s9).

Thereafter, an unillustrated driver is activated to start rotating pickup roller 6 (s10). This rotation of pickup roller 6 delivers a sheet of paper out from paper cassette 4 toward image forming unit 1. After it has been judged whether the paper which was fed is normal or not (s11), it is conveyed to the position facing toner support 22 in printing section 3. Subsequently, the image forming control unit supplies the created control-electrode controlling signal to control power source 31, which in turn applies a high voltage to annular electrodes 27 of control electrode 26 (s12). This supply of the control-electrode controlling signal is synchronized with the conveyance of paper 5 to printing section 3 by the rotation of a resist roller 95. Control power supply 31 controls the application of high voltage to annular electrodes 27 in accordance with the control-electrode controlling signal. By this control, a voltage of 150 V or −200 V is applied to each of annular electrodes 27 from control power source 31, thus controlling the intensity of the electric field near control electrode 26.

That is, at each gate 29 of control electrode 26, the jumping of toner 21 from toner support 22 toward opposing electrode 25 is inhibited or permitted in accordance with the image data so that the toner image, in conformity with the image signal, is formed on the surface of paper 5 which is moving at the rate of 30 mm/sec toward the paper output side by the rotational movement of resist roller 95. Paper 5 with the toner image formed thereon is conveyed to fixing unit 11, where the toner image is fixed to paper 5. Paper 5 with the toner image fixed thereon is discharged by an unillustrated discharge roller onto a paper output tray. When an unillustrated paper discharge sensor detects that paper 5 is discharged properly (s13), opposing electrode 25 is rotated one revolution (s14). Then, it is judged whether there is image data for the next page. If there is, the operation returns to s1, and if not, the image forming operation is finished (s15).

In the above process of this image forming apparatus, the image is directly formed on paper 5 without using any photoreceptor or dielectric drum etc., for development. Accordingly, there is no possibility of causing degradation of formed images. Further, the configuration of the apparatus can be simplified needing a fewer number of parts, thus making it possible to reduce the size and cost of the apparatus.

Figure 6:
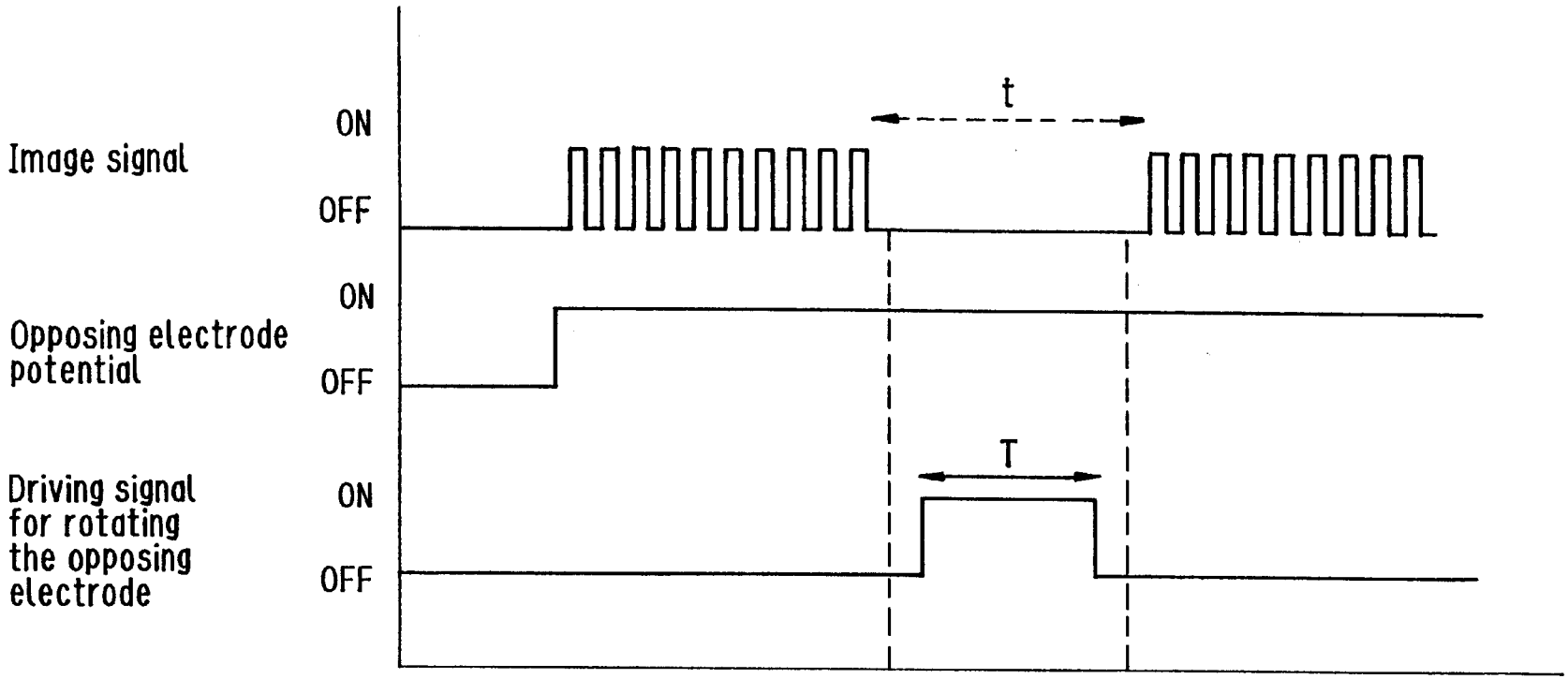
FIG. 6 is a timing chart showing a control signal for the opposing electrode in the image forming apparatus.

FIG. 6 is a timing chart showing the detailed control of the rotation of the opposing electrode in the above image forming apparatus. Application of high voltage to opposing electrode 25 is continued during the printing time because of the implementation of s9 shown in FIG. 5. On the other hand, the supplying of the image signal to annular electrodes 27 of control electrode 26 is interrupted during the interval between papers 5. Within time t of the interruption of the image signal, a rotation driving signal for supplying the rotational force for one revolution of opposing electrode 25 is supplied during a period T shorter than the interruption time t.

Figure 7:
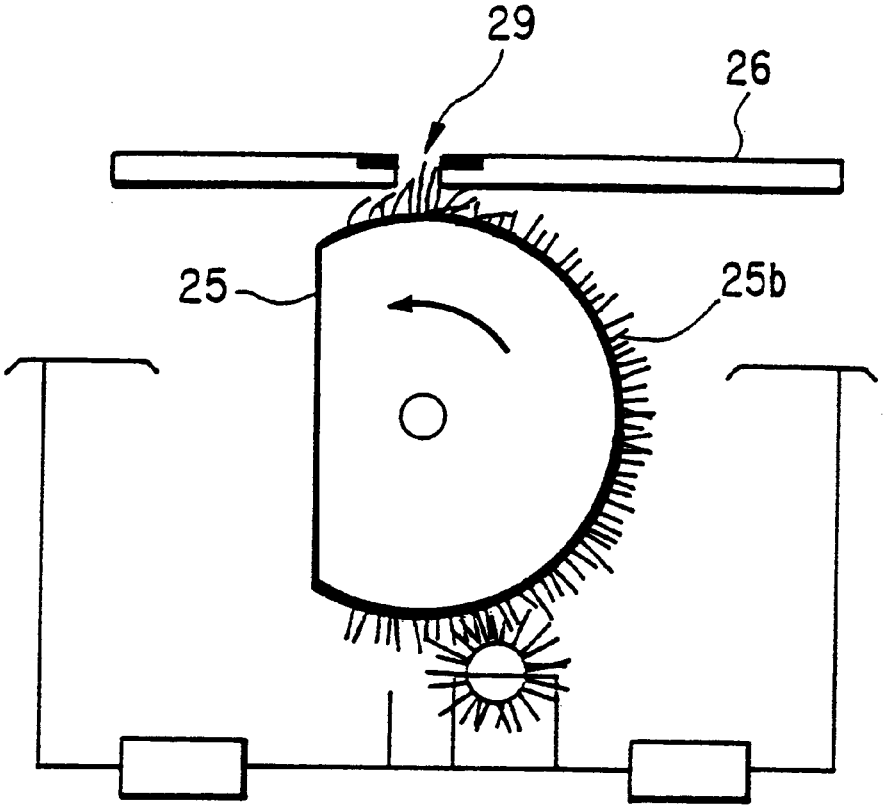
FIG. 7 is an illustrative view for explaining the operation of cleaning the control electrode in the image forming apparatus.

As shown in FIG. 7, as opposing electrode 25 is rotated, circumferential brush portion 25*b* of the opposing electrode comes into contact with the undersurface of control electrode 26. Also during the time brush portion 25*b* is in contact with undersurface of control electrode 26, application of the high voltage to opposing electrode 25 is continued. Accordingly, during the image forming operation for one page, brush portion 25*b* can impart an extremely intensive electric field against the adhering toner to control electrode 26. Thus, the toner adhering to control electrode 26 can be definitely removed therefrom by brush portion 25*b*.

During this operation of cleaning the adhering toner by brush portion 25*b*, the same high voltage is continuously applied to opposing electrode 25 as in the image forming operation, but brush portion 25*b* of opposing electrode 25 is in contact with or in proximity with control electrode 26. Therefore, the toner adhering to control electrode 26 receives a stronger electric field from brush portion 25*b* than that imparted from opposing electrode 25 during image forming. Thus, the toner which could not be made to jump from control electrode 26 toward opposing electrode 25 during image forming and remains adhering to control electrode 26, can be definitely removed from control electrode 26 by brush portion 25*b* in the cleaning mode.

In the above configuration, the voltage applied to opposing electrode 25 during the cleaning mode is identical with that applied to opposing electrode 25 during the image forming mode, therefore, the same voltage power source used during the image forming mode can be used for the cleaning mode. As a result, it is possible to stop increase in the size and cost of the apparatus resulting from an added number of parts because there is no extra needs of a high voltage and its control circuit. Further, since the toner adhering to control electrode 26 is adapted to be removed from control electrode 26 by means of a brush, it is possible to remove the toner adhering to the interior of gates 29 by inserting the front ends of the brush into the interior of gates 29 of control electrode 26.

Figure 8:
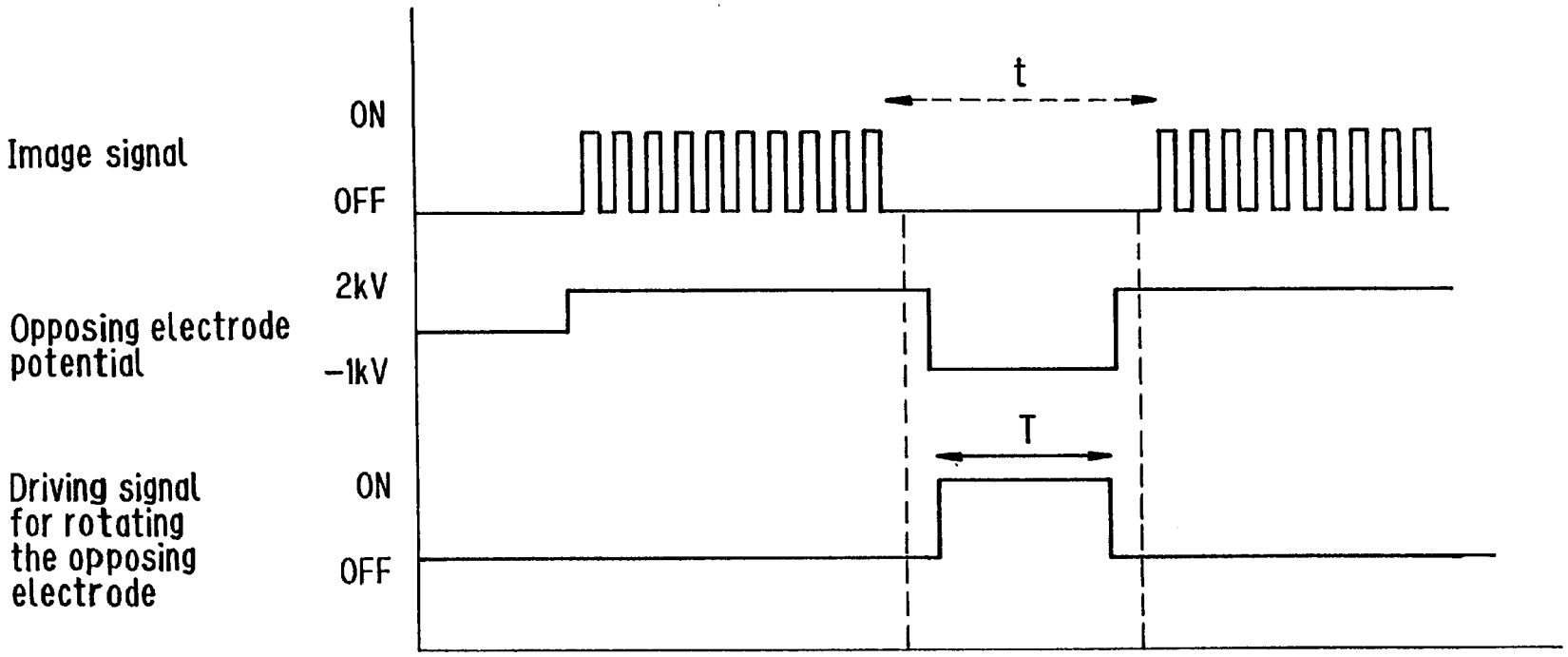
FIG. 8 is a timing chart showing a control signal for the opposing electrode in an image forming apparatus in accordance with the second embodiment of the invention.

FIG. 8 is a timing chart showing the relationship between the image signal and the signal delivered to the opposing electrode in the image forming apparatus of another embodiment of the invention. As shown in FIG. 8, the voltage applied to opposing electrode 25 during the cleaning mode may be made opposite to that applied to opposing electrode 25 during the image forming mode. In this case, another high-voltage power source and its control circuit should be provided or it is also possible to apply different voltages by a resistor dividing method. When a voltage of a like polarity is applied to opposing electrode 25 and a voltage of the opposite polarity is applied to second cleaning means 37, it is possible to create an electric field between opposing electrode 25 including a flat portion 25*a* as an opposing portion and brush portion 25*b* and second cleaning means 37 so that the toner transferred from control electrode 26 to opposing electrode 25 is removed from opposing electrode 25 by means of the second cleaning means.

Further, there are cases where toner having static charge of a polarity opposite the predetermined polarity adheres during the image forming mode. In such a case, a voltage of the opposite polarity to that applied to opposing electrode 25 during the image forming mode can be applied to opposing electrode 25 during the cleaning mode. This is effective in removing the toner having static charge of an opposite polarity from control electrode 26.

Further, when toner adhering to control electrode 26 has been left for a prolonged period of time, the voltage imparted to the toner is neutralized thus varying the amount of static charge on the toner, or the polarity might even be reversed. When an image forming operation is interrupted due to paper jam etc., the toner behaves in an unpredictable manner, so that the static potential of the toner changes to the opposite polarity. Even in such a case, it is possible to remove toner having static charge of the opposite polarity from control electrode 26 by applying a voltage of an opposite polarity to that applied to opposing electrode 25 during the image forming mode, to opposing electrode 25 during the cleaning operation mode.

Accordingly, switching of voltages to be applied to opposing electrode 25 is preferably implemented, after the at completion of a plural number of image forming operations, before the start of, or after the completion of, an image forming operation or when image forming has been interrupted by some occurrence such as jam etc. It should be noted that when a large amount of toner having static charge of the opposite polarity is adhering to control electrode 26, the polarity of the voltage to be applied to opposing electrode 25 may be switched during every interval of sheet feeding.

In order to improve the cleaning effect of brush portion 25*b* of opposing electrode 25 and second cleaning means 37, it is also possible to apply a voltage having an a.c. component to brush portion 25*b* of opposing electrode 25 and second cleaning means 37 during the cleaning mode. In this case, a power source which can supply a voltage containing an a.c. component is used as a cleaning power source 30*b*. This configuration enables thorough cleaning of control electrode 26 even when the toner having a strong adhesion is used or when cohesion between the toner particles or molecular adhesion of the toner particles increases due to change in the ambient conditions. Actually, by impressing an oscillating electric field to opposing electrode 25 formed with brush portion 25*b*, the pattern of equi-potential surfaces near gates 29 varies and the direction of the electric field formed alters. This causes the toner adhering to control electrode 26 to vibrate so as to weaken the adherence of the toner to control electrode 26.

Figure 9:
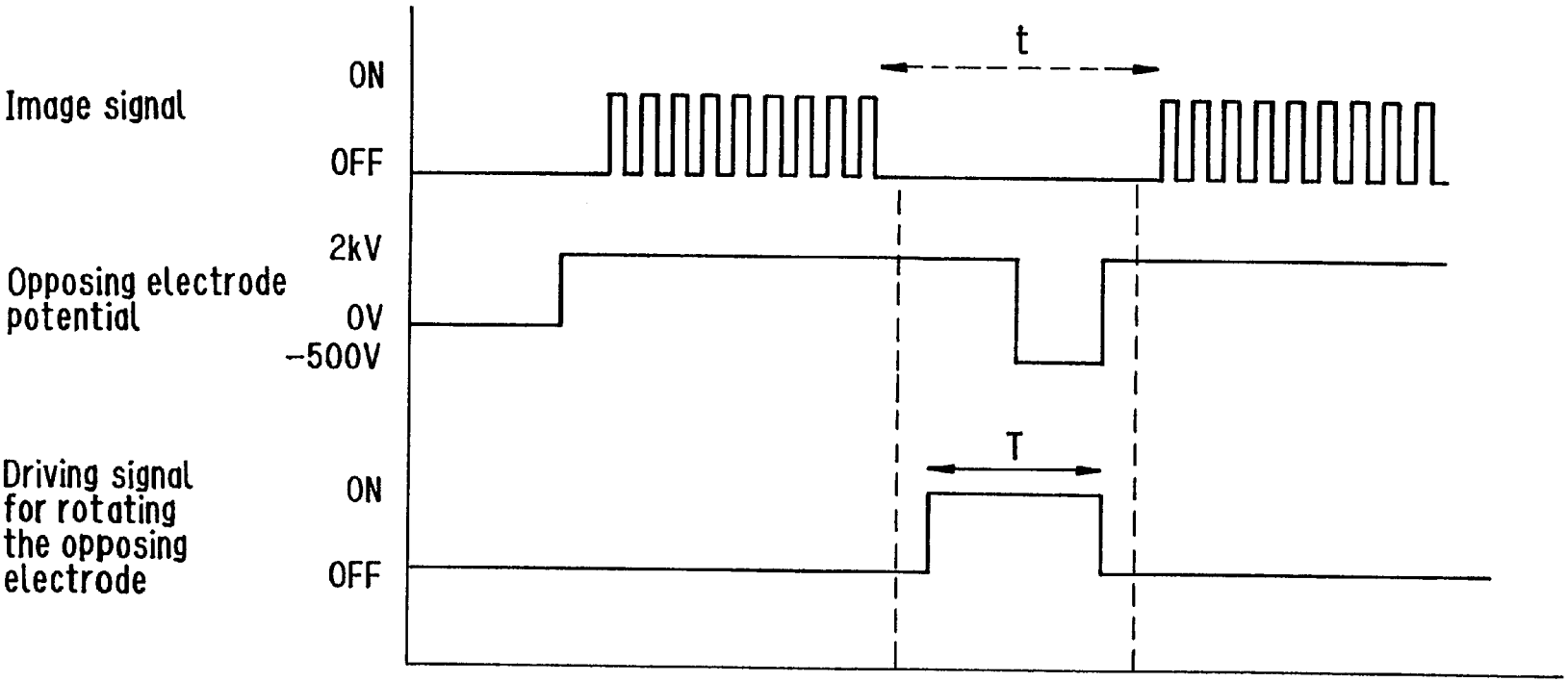
FIG. 9 is a timing chart showing a control signal for the opposing electrode in an image forming apparatus in accordance with the third embodiment of the invention.

FIG. 9 shows a timing chart of the control signal for the opposing electrode in the image forming apparatus in accordance with another embodiment of the invention. Opposing electrode 25 is rotated one revolution within time T which is shorter than the interval between paper feedings, or the time t during which no image signal is outputted in the image forming operation. During this period of time T, a voltage of 2 kV which is identical with that applied to opposing electrode 25 during the image forming mode is applied during the first half term of time T, and then a reversed voltage of −500 V is applied to opposing electrode 25 during the second half term of time T. Switching of the voltage to be applied to opposing electrode 25 is implemented by a switching means 30*c* provided in cleaning power source 30*b*.

Figure 10A:
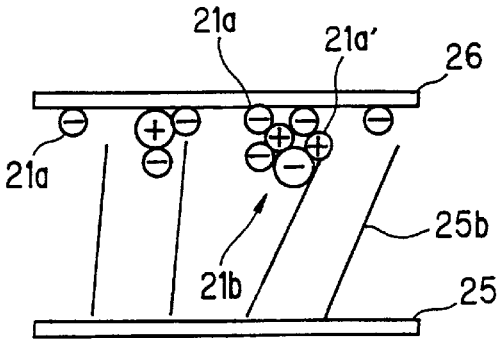
FIGS. 10A–10C are schematic diagram for explaining the cleaning state of the control electrode in the image forming apparatus.
Figure 10B:
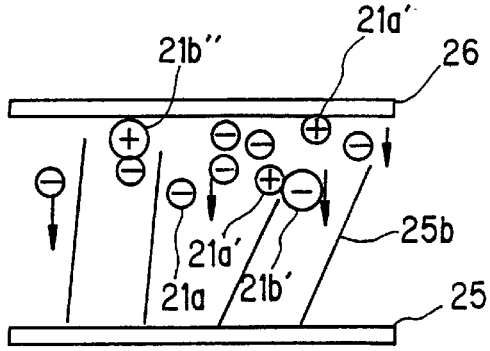
Figure 10C:
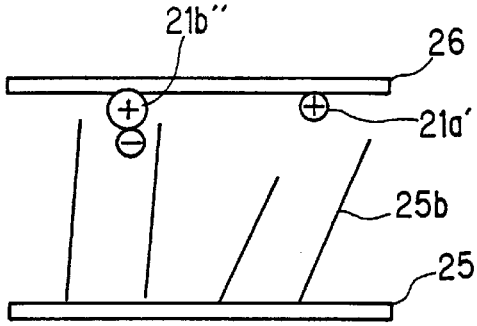

FIGS. 10A–10C are schematic views showing the cleaning states of the control electrode in accordance with the above control scheme. As shown in FIG. 10A, in the image forming apparatus using negatively charged toner, there are cases where aggregations 21*b* of toner particles which are negatively charged as a whole adhere to control electrode 26 other than toner particles 21*a* which are individually negatively charged. Toner aggregation 21*b*, although as a whole is electrified with a voltage which can be removed from control electrode 26 by means of brush portion 25*b* of opposing electrode 25 which is applied at 2 kV, may contain toner particles 21*a* bearing static charge of the normal polarity and toner particles 21*a*' bearing static charge of the opposite polarity.

If brush portion 25*b* touches such a toner aggregation 21*b* containing toner particles 21*a*' of the opposite polarity, the toner aggregation 21*b* is broken into single toner particles 21*a*, 21*a*' or a smaller aggregations 21*b*', 21*b*", as shown in FIG. 10B. Of these, toner particles 21*a*° or toner aggregation 21*b*" having reverse charge characteristics, which were contained in toner aggregation 21*b*, cannot be removed from control electrode 26 by means of brush portion 25*b* which is applied with a voltage having the same polarity as these particles, therefore they will stay on control electrode 26 as shown in FIG. 10C.

To deal with this, the voltage applied to opposing electrode 25 is controlled during the cleaning operation, as shown in FIG. 9. Specifically, with a voltage of 2 kV applied to opposing electrode 25, negatively charged toner 21*a* is removed from control electrode 26, and then positively charged toner 21*a*' and 21*b*" is removed from control electrode 26 by switching the voltage applied to control electrode 25 to −500V. In this way, the toner adhering to control electrode 26 can be removed to opposing electrode 25 side.

In this case, when a greater amount of toner having the opposite polarity to the predetermined polarity, tends to adhere to control electrode 26, a voltage of −500 V may be applied first during the cleaning operation and subsequently a voltage of 2 kV may be applied.

In the above control operation, flat portion 25*a* as the opposing portion of opposing electrode 25 is constantly arranged in parallel to control electrode during the image forming operation. During the cleaning mode in which no image is formed, opposing electrode 25 rotates one revolution to cause brush portion 25*b* to come into contact with control electrode 26. During this cleaning operation, opposing electrode 25 always rotates in one direction. Therefore, even if the polarity of the voltage applied to opposing electrode 25 is switched to the opposite polarity, the toner having transferred from control electrode 26 to brush portion 25*b* will not face control electrode 26 again, no toner captured by brush portion 25*b* will return and adhere to control electrode 26.

Figure 11:
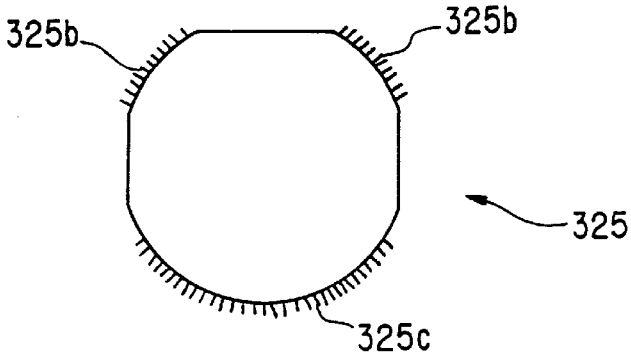
FIG. 11 is a view showing a cross-section of an opposing electrode in the image forming apparatus in accordance with another embodiment of the invention.
Figure 12:
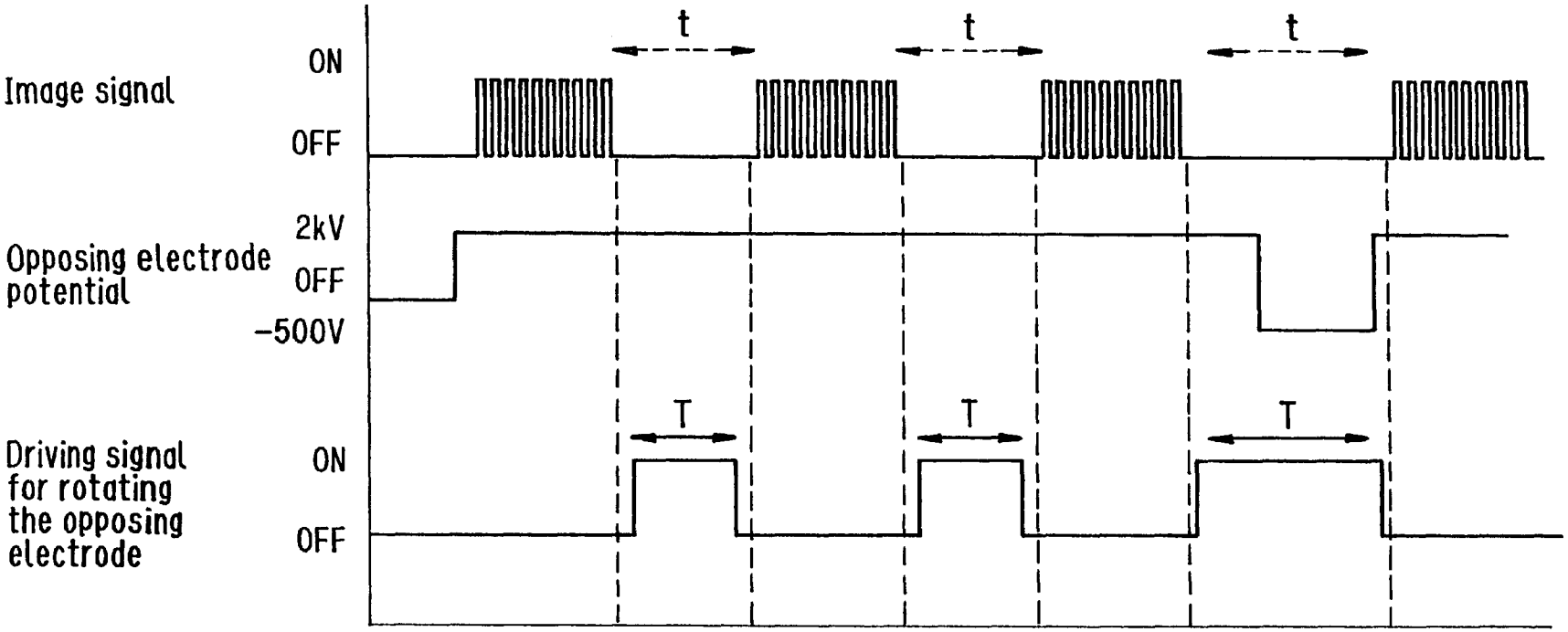
FIG. 12 is a timing chart showing a control signal for the opposing electrode in the image forming apparatus.

It is not necessary to perform the control process of the application of voltage to the opposing electrode shown in FIG. 9 for every cleaning operation; if a smaller amount of toner adheres to control electrode 26, this control process may be performed once in a predetermined number of cleaning operations. As an example of such a case, when an opposing electrode 325 having a cross-sectional shape shown in FIG. 11 is used, it is possible to alternate two short-term cleaning operations for time T and one long-term cleaning operation for time T'. That is, a short-term cleaning operation is executed when brush portion 325*b* of opposing electrode 325 faces control electrode 26 while a long-term cleaning operation is made when brush portion 325*c* of opposing electrode 325 faces control electrode 26. In this case, however, it is necessary to change the paper feed timing, or change the paper interval from time t to a longer time t'.

As stated above, during cleaning, brush portion 25*b* of opposing electrode 25 and the brush of second cleaning means 37 come into contact with control electrode 26 in a state where high-voltage is applied. Therefore, charge is liable to arise on the surface of brush portion 25*b* of opposing electrode 25 and the surface of second cleaning means 37. If this charge accumulates, the potential of brush portion 25*b* of opposing electrode 25 and second cleaning means 37 changes causing deficiency in the cleaning of control electrode 26. In the image forming apparatus of this invention, since an electrically conductive fabric having a resistance of about 100 kΩ·cm is used for brush portion 25*b* of opposing electrode 25 and second cleaning means 37, the charge generated from the contact with control electrode 26 will be eliminated immediately, having no influence on the cleaning operation of control electrode 26. The resistance of brush portion 25*b* of opposing electrode 25 and the brush of second cleaning means 37 is preferably set at $10^3$ to $10^{12}$ kΩ·cm in accordance with the capacity of the high-voltage power source.

In the above embodiment, although an image forming apparatus using toner as the developer was exemplified, it is also possible to apply the invention to an image forming apparatus using ink as the developer. Further, although an image forming apparatus having a control electrode with annular electrodes 37 was exemplified in the above embodiment, it is also possible to apply the present invention to an image forming apparatus having a control electrode which controls toner transfer from the toner support to opposing electrode by providing a plurality of strip-like electrodes matrix-wise or crossing over each other at right angles and governing the voltage to be applied to each of the strip-like electrodes.

Figure 13A:
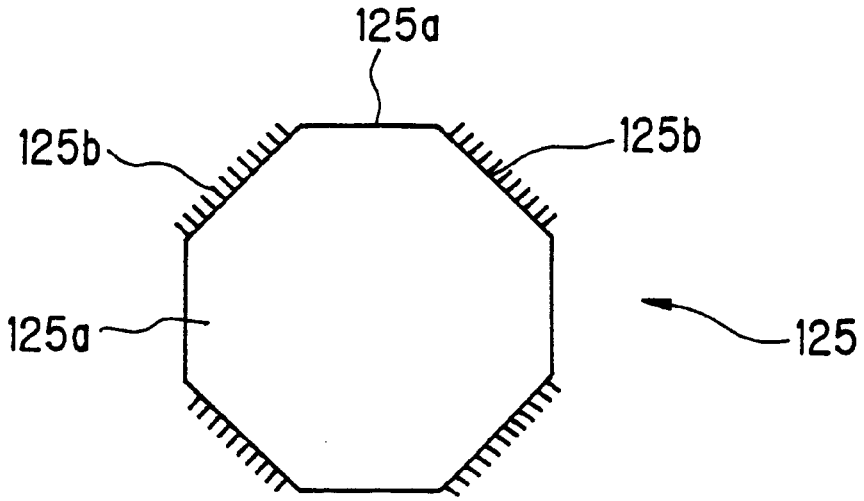
FIGS. 13A and 13B are sectional views showing opposing electrodes in the image forming apparatus in accordance with other embodiments of the invention.
Figure 13B:
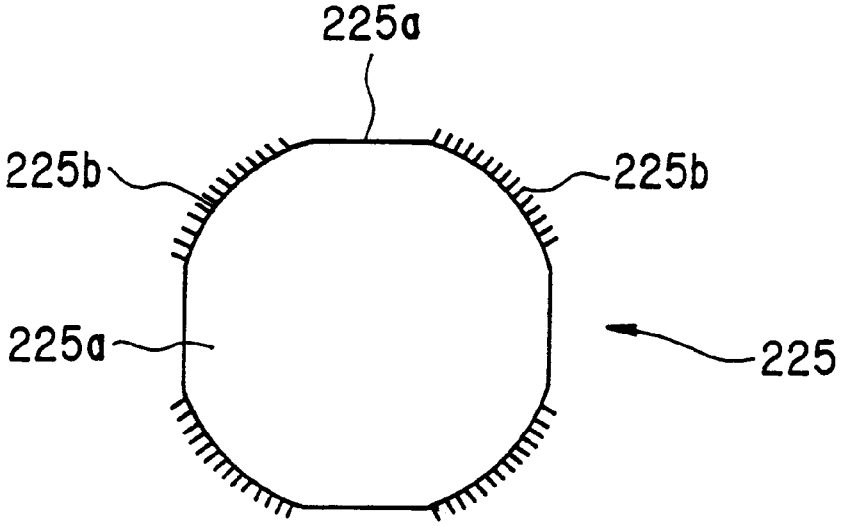

FIGS. 13A and 13B are diagrams showing the configurations of opposing electrodes used in the image forming apparatus in accordance with other embodiments of the invention. An opposing electrode 125 shown in FIG. 13A, has a polygonal cross-section, where flat portions 125*a* as the opposing portions and brush portions 125*b* are alternately formed. In the case, for example, where an opposing electrode 125 has a regular octagonal cross-section, one sheet of image forming is effected with flat portion 125*a* facing toner support 22, then opposing electrode 125 is turned one-fourth of a revolution during the paper feeding interval before the next sheet feeding. This rotation of opposing electrode 125 causes brush portion 125*b* to clean control electrode 26 before the image forming operation for the next sheet.

Accordingly, in accordance with this configuration, it is possible to reduce the rotational angle of opposing electrode 125 and hence shorten the paper feeding interval without shifting the rotational rate of opposing electrode 125, thus making it possible to reduce the time required for the image forming task. Specifically, when an opposing electrode has a n-sided polygonal cross-sectional shape, the time required for cleaning control electrode 26 can be shortened to 2/n if the opposing electrode is rotated at a constant rotational rate. Further, if the feeding speed of the sheet is constant, the distance between a sheet to the next to pass between the control electrode and opposing electrode for allowing the cleaning of control electrode 26 can be reduced to 2/n.

An opposing electrode 225 shown in FIG. 13B is formed of a cylinder made up of, e.g. aluminum, and has a plurality of flat portions 225*a* as the opposing portions, equiangularly disposed on the circumference with brush portions 225*b* formed on the circumferential or curved surfaces between flat portions 225*a*. This configuration of opposing electrode 225, in addition to the effects obtained from opposing electrode 125 configured as in FIG. 13A, makes it possible to maintain the abutted state of brush portion 225*b* against the undersurface of control electrode 26 uniform during the rotation of opposing electrode 225. Further, opposing electrode 225 can be more easily fabricated than opposing electrode 125, achieving a reduction in cost.

It is also possible to configure the apparatus such that the cleaning of the control electrode by rotating the opposing electrode occurs before the start of the image forming operation so that the image forming operation is started after the cleaning of the control electrode. It is also possible to implement the cleaning operation of the control electrode by rotating the opposing electrode in the recovery time after the interruption of the image forming operation due to paper jam or other deficiency.

Figure 14:
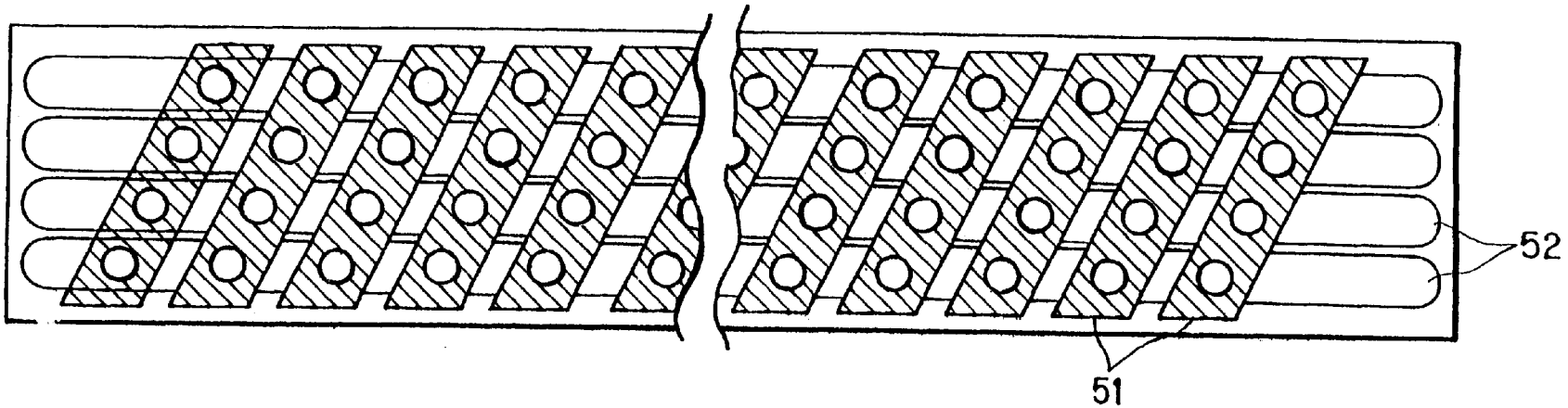
FIG. 14 is a plan view showing essential components of a control electrode provided in another image forming apparatus to which the present invention is applied.

In the above embodiment, although toner was used as the developer, it is also possible to use ink. Further, instead of using control electrode 26 having annular electrodes 27, it is also possible to control toner transfer from the toner support by providing a plurality of strip-like electrodes 51 and 52 matrix-wise on both sides of the substrate as shown in FIG. 14 and governing the voltage to be applied to the strip-like electrodes crossing over each other at right angles or at an angle.

Figure 15:
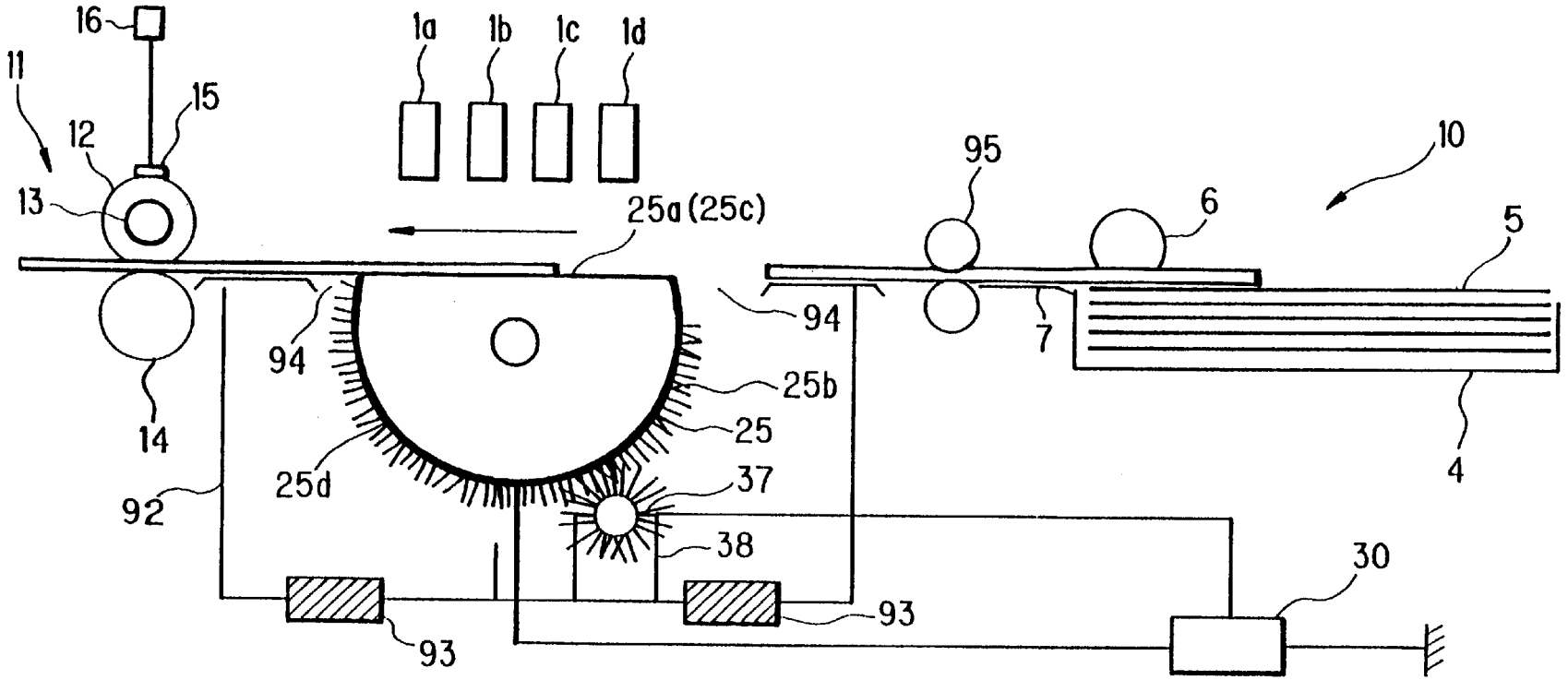
FIG. 15 is a schematic view showing the configuration of essential components of a color image recording apparatus to which the present invention is applied.

Further, the present invention can be applied in the same manner to a color image forming apparatus, as shown in FIG. 15, which has a plurality of image forming units 1*a*–1*d* made up of toner supplying sections and control electrodes wherein toner supplying sections are filled with toners, e.g., yellow, magenta, cyan and black. By applying the present invention to the thus configured color image forming apparatus, it is possible to secure the desired amount of toner to obtain adequate dot size and dot density, making it possible to create color images excellent in color reproduction.

The present invention can also be applied in the same manner to an image forming apparatus which has a toner supplying section of an ion flow type using an ion source such as corona charger etc.

In accordance with the invention of the first configuration, an opposing electrode as a rotary body having a cleaning portion on the circumferential surface thereof is made to come closer to the control electrode during the non-image forming mode, thus allowing an extremely simple structure to clean the toner adhering to the control electrode. Consequently, it is possible to definitely prevent degradation of formed images without increase in the size and cost of the apparatus.

In accordance with the invention of the second configuration, even when toner having static charge of an opposite polarity to the predetermined polarity is adhering to the control electrode, it is possible to reliably remove the toner adhering to the control electrode.

In accordance with the third and fourth configurations of the invention, the rotational angle of the rotary body during the non-image forming mode can be reduced so that the feeding intervals between recording media can be shortened, thus making it possible to shorten the time required for the image forming task.

What is claim is:

1. An image forming apparatus comprising:

a supporting medium for supporting an electrified developer;

an opposing electrode spaced a predetermined distance apart from the supporting medium and disposed facing the supporting medium;

a control electrode disposed between the supporting medium and the opposing electrode and having a plurality of gates which form passage for particles of the electrified developer;

a power source that selectively and variably applies a potential to the control electrode so as to selectively control transfer of the developer particles through the gates;

wherein a visual image is formed on a recording medium conveyed between the opposing electrode and the control electrode while varying the potential being applied to the control electrode;

wherein the opposing electrode is made up of a rotary body having a rotational axis orthogonal to the conveying direction of the recording medium so as to rotate during the non-image forming mode and so as to be in a non-rotating mode during the image forming mode; and wherein a circumferential surface of the rotary body is formed with an opposing portion which faces and remains in fixed relation with respect to the control electrode during the non-rotating mode and a cleaning portion which is one of comes closer to or in contact with the control electrode during rotation.

2. An image forming apparatus comprising:

a supporting medium for supporting an electrified developer;

an opposing electrode spaced a predetermined distance apart from the supporting medium and disposed facing the supporting medium;

a control electrode disposed between the supporting medium and the opposing electrode and having a plurality of gates which form passage for particles of the electrified developer;

a power source that selectively and variably applies a potential to the control electrode so as to selectively control transfer of the developer particles through the gates;

wherein a visual image is formed on a recording medium conveyed between the opposing electrode and the control electrode while varying the potential being applied to the control electrode;

wherein the opposing electrode is made up of a rotary body having a rotational axis orthogonal to the conveying direction of the recording medium so as to rotate during the non-image forming mode;

wherein a circumferential surface of the rotary body is formed with an opposing portion which faces the control electrode during the non-rotating mode and a cleaning portion which comes in contact with the control electrode during rotation; and wherein the direction or the strength of the electric field generated between the opposing electrode and the control electrode by the power source is varied during the non-image forming mode.

3. An image forming apparatus comprising:

a supporting medium for supporting an electrified developer;

an opposing electrode spaced a predetermined distance apart from the supporting medium and disposed facing the supporting medium;

a control electrode disposed between the supporting medium and the opposing electrode and having a plurality of gates which form passage for particles of the electrified developer;

a power source that selectively and variably applies a potential to the control electrode so as to selectively control transfer of the developer particles through the gates;

wherein a visual image is formed on a recording medium conveyed between the opposing electrode and the control electrode while varying the potential being applied to the control electrode;

wherein the opposing electrode is made up of a rotary body having a rotational axis orthogonal to the conveying direction of the recording medium so as to rotate during the non-image forming mode;

wherein a circumferential surface of the rotary body is formed with an opposing portion which faces the control electrode during the non-rotating mode and a cleaning portion which comes in contact with the control electrode during rotation; and wherein the circumferential surface of the rotary body is formed so as to have a plurality of opposing portions and cleaning portions being alternatively arranged on the peripheral surface of the rotary body along the circumference thereof.

4. An image forming apparatus comprising:

a supporting medium for supporting an electrified developer;

an opposing electrode spaced a predetermined distance apart from the supporting medium and disposed facing the supporting medium;

a control electrode disposed between the supporting medium and the opposing electrode and having a plurality of gates which form passage for particles of the electrified developer;

a power source that selectively and variably applies a potential to the control electrode so as to selectively control transfer of the developer particles through the gates;

wherein a visual image is formed on a recording medium conveyed between the opposing electrode and the control electrode while varying the potential being applied to the control electrode;

wherein the opposing electrode is made up of a rotary body having a rotational axis orthogonal to the conveying direction of the recording medium so as to rotate during the non-image forming mode;

wherein a circumferential surface of the rotary body is formed with an opposing portion which faces the control electrode during the non-rotating mode and a cleaning portion which comes in contact with the control electrode during rotation;

wherein the direction or the strength of the electric field generated between the opposing electrode and the control electrode by the power source is varied during the non-image forming mode; and wherein the circumferential surface of the rotary body is formed so as to have a plurality of opposing portions and cleaning portions being alternatively arranged on the peripheral surface of the rotary body along the circumference thereof.

5. An image forming apparatus comprising:

a supporting medium for supporting an electrified developer;

an opposing electrode spaced a predetermined distance apart from the supporting medium and disposed facing the supporting medium;

a control electrode disposed between the supporting medium and the opposing electrode and having a plurality of gates which form passage for particles of the electrified developer;

a power source that selectively and variably applies a potential to the control electrode so as to selectively control transfer of the developer particles through the gates and that applies a high-voltage to the opposing electrode;

wherein a visual image is formed on a recording medium conveyed between the opposing electrode and the control electrode while varying the potential being applied to the control electrode;

wherein the opposing electrode is made up of a rotary body having a rotational axis orthogonal to the conveying direction of the recording medium so as to rotate during the non-image forming mode;

wherein a circumferential surface of the rotary body is formed with an opposing portion which faces the control electrode during the non-rotating mode and a cleaning portion which comes in contact with the control electrode during rotation; and wherein the cleaning portion includes a brush portion and wherein high-voltage application to the opposing electrode is continued even while the brush portion comes in contact with an under surface of the control electrode.

* * * * *